United States Patent [19]

Hein et al.

[11] Patent Number: 4,989,561

[45] Date of Patent: Feb. 5, 1991

[54] METHOD AND APPARATUS TO CLEAN THE INTAKE SYSTEM OF AN INTERNAL COMBUSTION ENGINE

[75] Inventors: Steven R. Hein, Vancouver, Wash.; Sidney R. Clack, Molalla, Oreg.; Joel L. Burrows, Sterling, Va.

[73] Assignee: Precision Tune, Inc., Sterling, Va.

[21] Appl. No.: 522,430

[22] Filed: May 11, 1990

[51] Int. Cl.[5] ..... F02B 77/00

[52] U.S. Cl. ..... 123/198 A; 134/20; 134/30; 134/169 A

[58] Field of Search ..... 123/198 A; 134/20, 22.12, 134/22.14, 30, 39, 40, 102, 169 A

[56] References Cited

U.S. PATENT DOCUMENTS

| | | | |
|---|---|---|---|
| 1,240,977 | 9/1917 | Horn | 123/198 A |
| 2,201,774 | 5/1940 | Hofele | 141/1 |
| 2,664,440 | 7/1953 | Bailey, Sr. | 123/198 A |
| 3,173,408 | 3/1965 | Brenneman | 123/119 |
| 3,338,564 | 8/1967 | Roeder | 261/18 |
| 4,059,123 | 11/1977 | Bartos et al. | 134/102 |
| 4,161,160 | 7/1979 | Hicks et al. | 123/1 |
| 4,197,140 | 4/1980 | Swan | 134/20 |
| 4,520,773 | 6/1985 | Koslow | 123/198 A |
| 4,606,311 | 8/1986 | Reye et al. | 123/198 A |

OTHER PUBLICATIONS

"Intake Valve Deposits—Fuel Detergency Requirements Revisited" by Bitting, et al., published by Society of Automotive Engineers, SAE Technical Paper No. 872117, published Nov. 2, 1987.

"Mechanism of Intake—Valve Deposit Formation Part 1: Characterization of Deposits" by Esaki, et al., published by Society of Automotive Engineers, SAE Technical Paper No. 900151, published Feb. 26, 1990.

"Mechanism of Intake—Valve Deposit Formation Part 2: Simulation Tests" by Nomura, et al., published by Society of Automotive Engineers, SAE Technical Paper No. 900152, published Feb. 26, 1990.

*Primary Examiner*—Noah P. Kamen

*Attorney, Agent, or Firm*—Klarquist, Sparkman, Campbell, Leigh & Whinston

[57] ABSTRACT

The present invention is a method and apparatus to clean the intake system of an internal combustion engine including the intake valves. An air metering block is connected to the intake manifold of the engine by means of an adaptor tube. The only air that can get into the intake manifold of the engine is through inlet ports in the air metering block. An air adjusting screw selectively uncovers the inlet ports to vary the amount of air which can be introduced into the intake manifold. An electrically operated injector is fitted in the air metering block to inject solvent directly into the intake manifold. An adjustable injector driver varies the duty cycle or the on time of the injector to control the amount of flow of solvent into the intake manifold. A pumping unit is provided to pump solvent from a holding tank, through the injector, into the intake manifold. The normal fuel flow to the engine is disconnected such that the engine runs on combustion of the solvent introduced by the injector through the air metering block. The engine continues to operate until the predetermined amount of solvent has been burned.

21 Claims, 4 Drawing Sheets

METHOD AND APPARATUS TO CLEAN THE INTAKE SYSTEM OF AN INTERNAL COMBUSTION ENGINE

TECHNICAL FIELD

The present invention relates to a method and apparatus to clean the intake system, including the intake valves, of an internal combustion engine. Specifically, the apparatus provides a device for spraying a controlled amount of solvent into the air intake system of an internal combustion engine to dissolve and remove deposits on all the components in the air flow of the air intake system of the engine, including the intake valves.

BACKGROUND ART

Modern unleaded gasolines, after combustion, leave deposits on various components of internal combustion engines. Evidence of these deposits may be seen by inspecting the tailpipe or opening the throttle blades and using a light to visually inspect the visible portions of the intake system. Many of these deposits are controlled by adding detergent compounds to the gasoline. Generally speaking, super unleaded fuels contain a higher concentration of this detergent additive which may provide a reasonable job of control of undesired deposits in the intake system. For these detergent additives in the fuel to remove deposits from various parts of the engine, they need to be sprayed on the parts that require cleaning. This cleaning action of the fuel additives performs reasonably well on throttle body style fuel injection systems as the fuel is sprayed at the initial point of air flow into the engine which allows detergent compounds within the fuel to maintain the intake system in a reasonably clean condition.

This is not the case with port fuel injection system engines. This type of system sprays fuel directly in the air stream just before the intake valves. As a result, the components in the intake manifold from the air intake down to the point where the fuel injectors spray the fuel are subject to formations of unwanted deposits from oil from the crank case ventilation system and exhaust gases from exhaust gas recirculation systems. These deposits contribute to form a "dirty" intake system. No matter what brand or quality of fuel is used or how often the fuel injectors are cleaned or which additives are used, they will not eliminate these deposits as the cleansing action of the detergents contained in the fuel are not applied to the components that are located upstream of the fuel injectors.

Most modern engines contain many components in the path of air flow into the engine that are affected by these deposits. These components include: intake valves, fuel injector nozzles, idle air by-pass valves, throttle plates, exhaust recirculation valves, air charged temperature sensors, knock sensors, air flow meters, turbo chargers, and safety valves. Not all of these components are present in all engines.

Deposits on these components can result in a wide variety of driveability complaints with the most common problems being unstable idle speed control and stumbling when cold.

In addition, deposits on the intake valves act like sponges and absorb fuel which degrades cold starts. Intake valve deposits also restrict air flow, reducing both low speed and high speed performance. Current fuel additives are not completely successful in minimizing or eliminating deposits on the intake valves.

The normal method of cleaning intake systems and intake valves is to partially or completely disassemble the engine. The intake manifold is removed from the engine. All components are removed from the manifold and cleaned or replaced. The intake manifold is cleaned. The head is removed from the engine. The valves are removed from the head and cleaned or replaced. The engine is then reassembled. This, of course, is time consuming and expensive.

Another method to clean the intake valves is to remove the fuel injectors, insert a sandblasting tip, and blast the intake valves, in place, with a blasting media such as crushed nut shells. This is not completely satisfactory because of uneven cleaning and the difficulty in removing the residue of the crushed nut shells.

A need, therefore, exists for a method and apparatus to clean the intake system of an internal combustion engine without disassembling the engine.

SUMMARY OF INVENTION

An object of the invention is to provide an apparatus for cleaning deposits from the intake system of an internal combustion engine, without disassembling the engine.

Another object of the invention is to provide an apparatus which can easily and quickly be connected to the intake system of an internal combustion engine and which can facilitate the removal of deposits from all components exposed to incoming air flow including the intake valves of the engine.

Still another object of the invention is to provide an apparatus which can control air flow and solvent flow into the intake system of an internal combustion engine to clean the intake system of unwanted deposits.

The present invention provides an apparatus which can be attached to the intake system of an internal combustion engine to clean the intake system and the intake valves by feeding a combustible, solvent containing mixture into the intake system. The only components of the engine assembly which need to be removed in order to attach the cleaning apparatus is the interconnection hose between the air cleaner and the air intake manifold. A coupling hose and hose clamps connects an air metering block directly to the intake manifold of the internal combustion engine. The air metering block has an air intake port and a plurality of air outlet ports. An air adjustment screw selectively blocks off a portion of the air outlet ports to adjust the amount of air flow into the engine.

An electrically controlled injector similar to an electrical pulse actuated fuel injector is mounted in the air metering block. A pumping unit supplies a predetermined amount of solvent to the injector. The injector will only inject the solvent into the manifold when an electrical signal is sent to the injector. An injector driver is coupled to the injector and receives its power from the battery of the automobile. An inductive pick up coil is placed around one of the spark plug wires. The injector driver only outputs an electrical pulse to the injector when the engine is cranking and a signal is sensed on the spark plug wire or when a purge switch on the body of the injector driver is pressed.

During cleaning, the fuel feed to the engines' fuel injectors is disabled by either disconnecting the electric fuel pump or disconnecting the electrical leads to the engine's fuel injector. The injector driver is adjustable to increase or decrease the length of electrical pulses sent to the injector of the cleaner and, thus, the amount of solvent passing through the injector.

The solvent, after it is injected into the intake manifold, is drawn into the engine, past the intake valves, and is ignited by the engine ignition system causing the engine to run. The solvent and the deposits dissolved by the solvent are burned in the engine and passed through the exhaust of the engine. The engine continues to operate until all of the solvent is expended from the pumping unit.

Other objects and advantages of the present invention will be apparent from the following description of a preferred embodiment thereof and from the attached drawings.

DETAILED DESCRIPTION OF THE INVENTION

Figure 1:
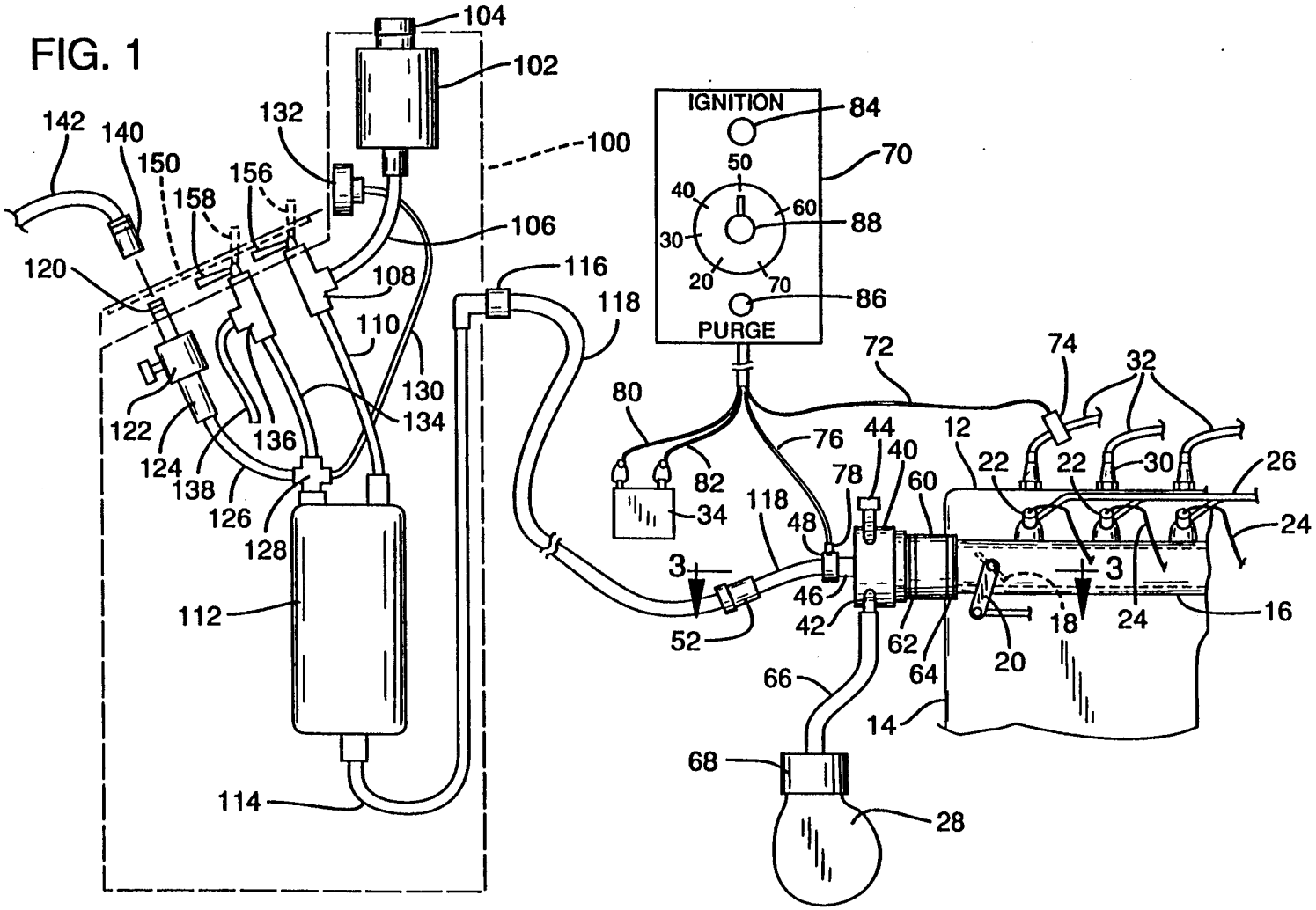
FIG. 1 is a schematic illustration of the cleaning apparatus of the present invention connected to an engine.

Referring now to FIG. 1, a portion of an internal combustion engine 10, having a head 12 and a block 14, is shown. An intake manifold 16 is attached to the head 12. A throttle plate 18 is located in intake manifold 16. Throttle plate 18 is controlled by exterior linkage 20. Port fuel injectors 22 are located in each branch of the intake manifold 16 just before the intake valves of the engine. Each fuel injector 22 is controlled through a fuel injector lead wire 24. When an electrical signal is passed over the fuel injector control lead wire 24, the injector opens and allows fuel from fuel supply manifold 26 to be sprayed into the engine.

The engine typically has a plurality of spark plugs 30 controlled through spark plug wires 32 which lead from a distributor (not shown) as is known in the automotive arts.

Also in conjunction with the engine 10, the automobile normally has an air cleaner 28 and a battery 34. In normal configuration, a connector hose (not shown) couples the air cleaner 28 to the intake manifold 16. This coupling hose is removed prior to the cleaning operation.

The apparatus of the invention comprises an air metering block 40 having an air intake port 42 and an air adjustment screw 44. Adjustment of the air adjustment screw 44 varies the amount of air flowing through the air intake port 42 as will be explained below.

The air metering block 40 also has an opening for accepting a single injector 46 which is operated by a solenoid 48. This injector is an electrical pulse modulated fuel injector similar to that used in the Nissan 300ZX automobile. Whenever an electrical signal is supplied to the solenoid 48 of the injector 46, the valve is open and fuel may pass through the injector.

The air flow metering block 40 is connected to the intake manifold 16 of the engine 10 by means of a coupling hose 60. Coupling hose 60 in a preferred embodiment is clear tubing and is connected by a hose clamp 62 to the air metering block 40 and hose clamp 64 to the intake manifold 16. This provides an air tight coupling so that the only air allowed to enter the intake manifold 16 is through the air inlet port 42 of the air metering block 40.

It should be noted that certain automobiles have a mass air flow sensor located upstream of the intake manifold, typically in the air cleaner 28. These engines will not run unless air flow is detected passing the air flow sensor. For this purpose, a draw-through air flow adapter 68 is designed to connect to the component holding the air flow sensor such as air cleaner 28. An air supply hose 66 interconnects draw-through air flow adapter 68 and the air inlet port 42. Therefore, any air which is drawn into the intake manifold 16 must come past the air flow sensor.

It should be noted that the draw-through air flow adapter 68 and hose 66 are not needed when cleaning the intake systems of automobiles not equipped with an air flow detector.

An injector driver 70 controls the opening and closing of the solenoid 48 of the fuel injector 46. The injector driver 70 has an ignition detector lead wire 72 connected to an ignition detector 74. The ignition detector 74 is an inductive pick up similar to that used with induction-type timing lights. The ignition detector 74 is placed over any spark plug wire 32 and sends an electrical signal to the injector driver 70 whenever the spark plug 30 is receiving an electrical signal over line 32. An injector control lead wire 76, sends an electrical signal from the injector driver 70 to the connector 78 of the solenoid 48 of the injector 46.

Two power leads 80 and 82 connect the battery 34 of the automobile to the injector driver 70 to provide power to the injector driver 70.

An ignition indicator light-emitting diode 84 is provided on the injector driver 70 and is lit whenever the ignition detector 74 detects an electrical signal being sent to the spark plug 30 over wire 32.

A purge prime switch 86 is also provided on the injector driver 70 and its purpose will be explained below. The injector driver 70 is adjustable with an injector driver flow rate control potentiometer 88. As the resistancy of this control 88 is increased, the duty cycle or the length of the electrical pulse sent to the injector 46 is increased increasing the period of time the injector 46 will remain open to feed solvent.

A pumping unit 100 is provided to supply pressurized solvent to the injector 46. Pumping unit 100 includes a reservoir 102 which can hold approximately one gallon of fluid solvent. A vented cap 104 is provided for reservoir 102. A first solvent supply line 106 is connected between reservoir 102 and a solvent control valve 108 which, when closed, prevents fluid from running from supply line 106. A second solvent supply line 110 connects the solvent control valve 108 to a tank 112. When solvent control valve 108 is closed, it provides an air tight system preventing any air from leaking back through solvent supply line 106.

Tank 112, in a preferred embodiment, is a corrosion resistant, stainless steel, pressure vessel holding approximately 20 ounces.

A third solvent supply line 114 exits the bottom of tank 112 and goes outside the frame work of pumping unit 100 to a coupler 116. A fourth solvent supply line 118 connects to coupler 116 on one end and to the fuel injector 46 on the opposite end. A filter 52 is provided in line 118.

Because of the corrosive nature of the solvents used in cleaning the intake manifold and the intake valves, conventional pumping units have been found to be unsatisfactory and fairly short lived. Therefore, the pump unit 100 uses air pressure as the pumping medium rather than a conventional pump. A male portion of a quick-connect coupler 120 is on the front face of the pumping unit 100 and is connected to a pressure regulator 122. Pressure regulator 122 is preset to allow approximately 30-35 pounds per square inch of air pressure to be applied to tank 112. The air from the pressure regulator 122 goes through a one-way check valve 124 to a first air supply line 126. A four-position T coupler 128 is connected to tank 112. A second air supply line 130 is connected from coupler 128 to a pressure gauge 132 mounted on the front face of the pumping unit 100. A third air supply line 134 from coupler 128 connects to a pressure relief valve 136. The output from pressure relief valve 136 goes to an air pressure bleed line 138. Air pressure bleed line 138 may go to an overflow catch container (not shown) or may be routed back to the reservoir 102 to contain any fluid which may be fed back through line 134 during venting of the tank 112.

During operation of the pumping unit 100, shop air through air line 12 is supplied to the pressure regulator 122 by coupling a female portion of a quick-connect coupler 140 to the male quick-connect coupler 120 previously described above. Typical shop air pressure runs between 95–125 PSI. The pressure regulator 122, as previously mentioned, reduces this pressure to 30–35 PSI. The amount of pressure on the tank 112 can be read on pressure gauge 132 on the front of pumping unit 100.

Once solvent has been introduced into tank 112, and the tank 112 is pressurized, no solvent can be sprayed into the intake manifold 16 through injector 46 until the solenoid valve 48 is activated.

Figure 2:
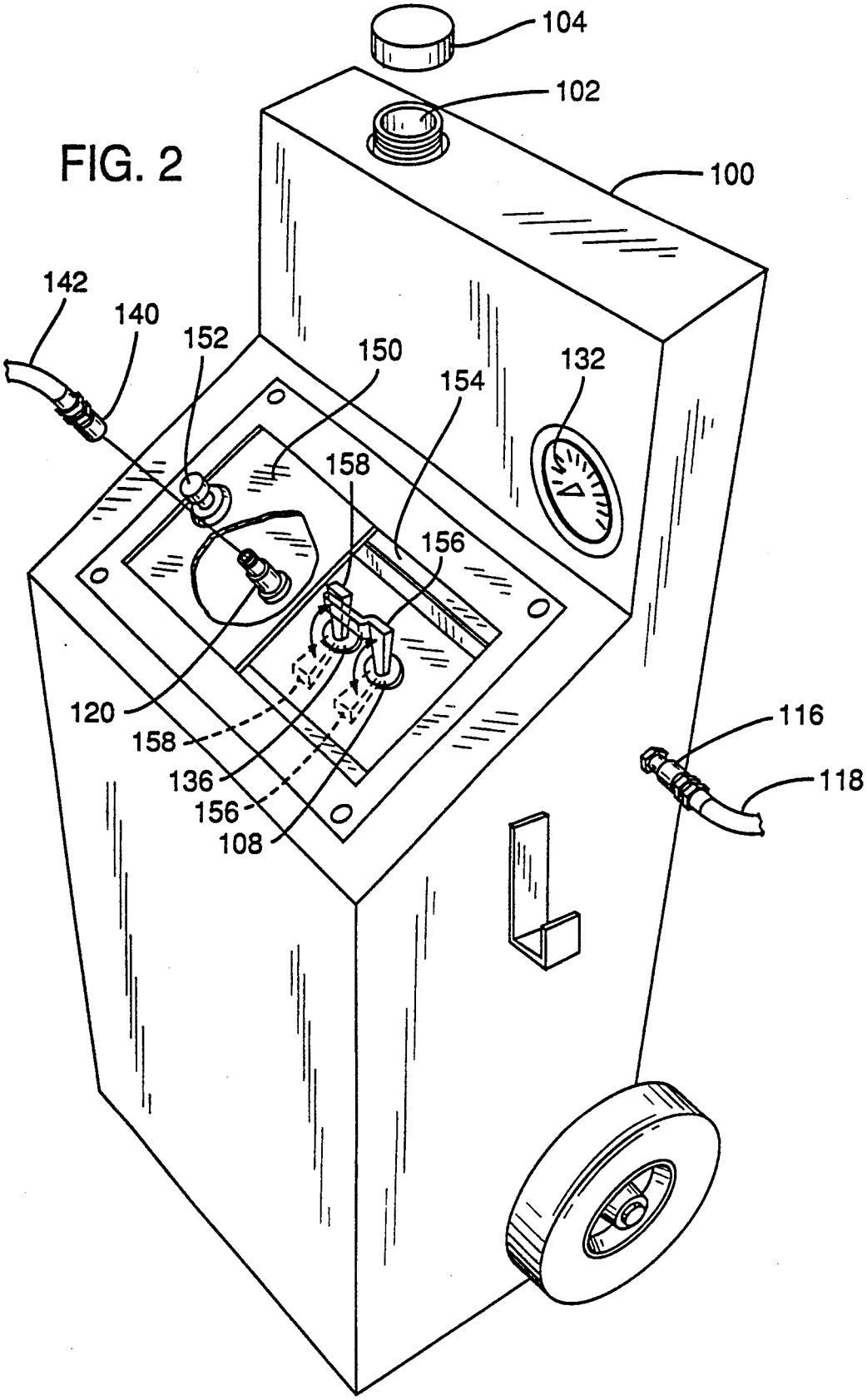
FIG. 2 is a perspective illustration of the pumping unit of the cleaning apparatus of the present invention.

As a safety feature, an interlock system is provided to prevent air pressure from being applied to the pumping unit 100 when either the solvent control valve 108 is open or the pressure relief valve 136 is open. This is accomplished by having a slidable interlock panel 150 on the front face of the pumping unit 100, see FIG. 2. The slidable panel has a knob 152 to facilitate sliding the panel to either the left or the right. The panel 150 slides in a set of guides 154 on the front face of the pumping unit loop. When interlock panel 150 is in a left-most position, the male quick-connect air coupler 120 is covered and the solvent control valve 108 and the pressure relief valve 136 are uncovered.

Solvent control valve 108 has a lever-type knob 156 to activate the valve. When the knob 156 is in the up position, the interlock panel 150, if moved from the left position toward the right, hits the knob 156 preventing the male quick-connector coupler 120 from being uncovered. Similarly, pressure relief valve 136 has a lever-type knob 158. When valve 136 is opened, knob 158 is in a vertical position and prevents the interlock cover 150 from uncovering the male quick-connect air coupler 120. Both knobs 156 and 158, thus, must be in the down position, closing their respective valves 108 and 136, before the interlock panel 150 may be slid to the right along guides 154 to uncover the male quick-connect air coupler 120. The interlock panel 150, therefore, prevents shop air from being applied to the male quick-connect air coupler 120 unless valve 108 and valve 136 are closed.

As an additional safety feature, knob 156 has a portion underlaying knob 158. Knob 158 controlling pressure relief valve 136 must be activated before knob 156 may activate valve 108. If knob 156 is attempted to be moved to the vertical position, prior to knob 158 being moved, the portion of knob 156 underlaying knob 158 will automatically force knob 158 to the vertical position, thus, opening valve 136 and relieving the pressure.

Figure 3:
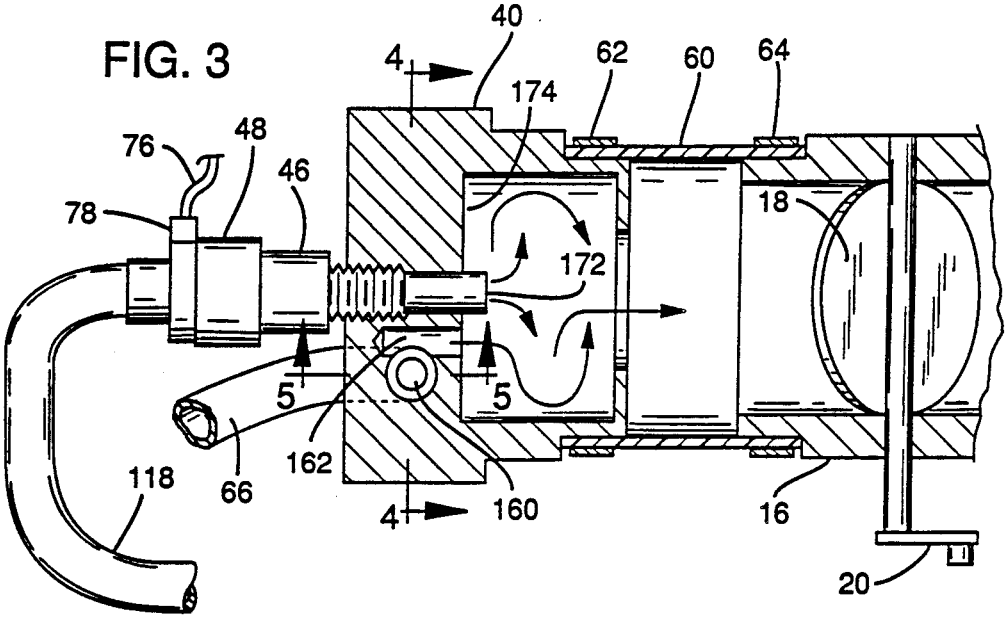
FIG. 3 is an enlarged, partial cross-sectional view of the air metering block and engine manifold of the present invention along lines 3—3 of FIG. 1.
Figure 4:
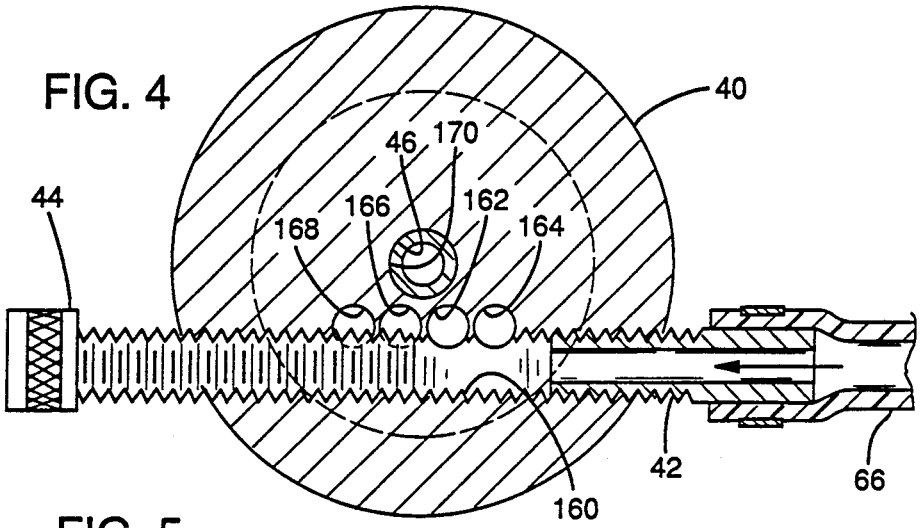
FIG. 4 is an enlarged, cross-sectional view of the metering block of the present invention along lines 4—4 of FIG. 3.
Figure 5:
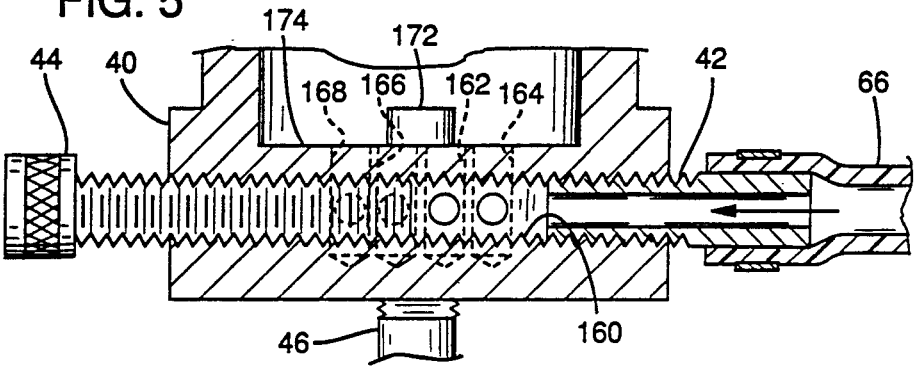
FIG. 5 is an enlarged, partial cross-sectional view of the air metering block of the present invention along lines 5—5 of FIG. 3.

Referring now to FIG. 3 through FIG. 5, specific details of the air metering block 40 are shown. Air inlet 42 is connected to an air passage 160 which is crossed-bored through the air metering block 40. On the other end of the air passage 160 is the air flow metering screw 44. A plurality of ports 162, 164, 166, and 168 are crossed-drilled to intersect with passage 160 and provide open passages on face 174 of air metering block 40. Retraction of the air metering screw 44 selectively uncovers all or portions of the various air inlet ports 162, 164, 166, and 168. This, therefore, varies the quantity of air which can be allowed to enter the intake manifold 16.

The injector 46 fits into an injector mounting hole 170 in the air metering block 40. The nozzle portion 172 of the injector 46 extends beyond the wall 174 which contains the air inlet ports 162, 164, 166, and 168. This allows the air entering from the air inlet ports to swirl about the outlet of the injector 172 to atomize the solvent mixture inside an air outlet passage which communicates with the inside of coupling hose 60. It should be noted that although, in this preferred embodiment, injector 46 is located within air metering block 40, it may also be mounted upstream of the air metering block 40, for instance, in hose 66 or air draw-through adapter 68, or downstream of the air metering block 40, such as in coupling hose 60.

Figure 6:
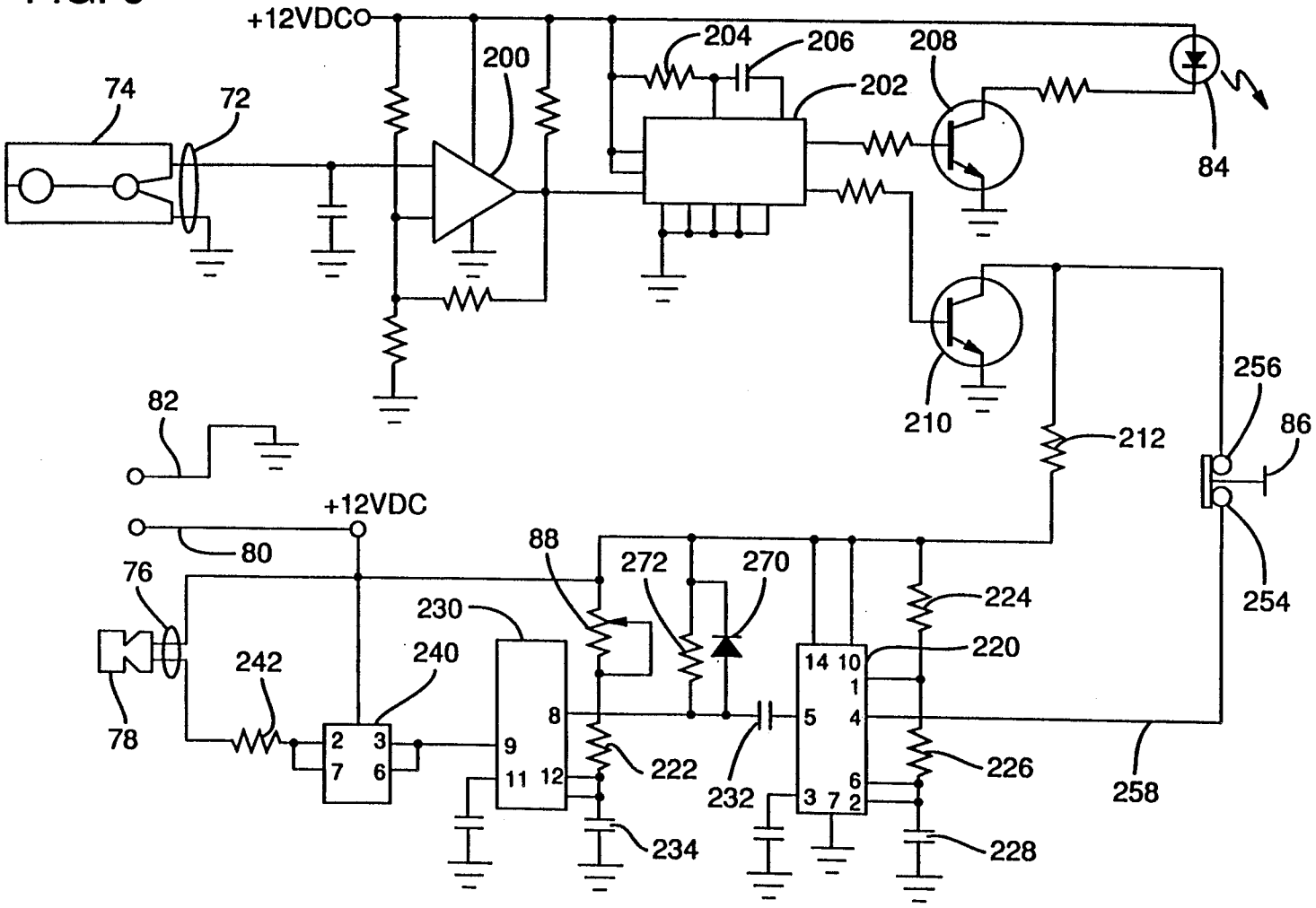
FIG. 6 is a schematic diagram of the electronic circuitry of the injector driver of the cleaning apparatus of the present invention.

Referring now to FIG. 6, the electronic components within the injector driver 70 are shown. The signal from the ignition detector 74 is sent to a level comparator 200 which in a preferred embodiment of the invention is an LM339 device. The signal from the level comparator 200 is sent to a monostable, retriggerable, multi-vibrator 202 which in a preferred embodiment is a 4528 device. Resistor 204 and capacitor 206 set the time constant of multi-vibrator 202. As long as pulses are delivered from the comparator 200 quicker than the time constant set by resistor 204 and capacitor 206, the output of the monostable, retriggerable, multi-vibrator 202 is constant. The values of resistor 204 and capacitor 206 are chosen such that a cranking speed on the engine of 300 RPM or more will cause the monostable, retriggerable, multi-vibrator 202 to provide a constant output.

One output of multi-vibrator 202 is fed through transistor 208 which, when conductive, allows current to flow through light-emitting diode 84 to indicate that the ignition is working and the spark plug 30, shown in FIG. 1, is receiving electrical signals over line 32.

The second output of multi-vibrator 202 is fed through transistor 210 and then to free-running oscillator 220 via contact 256 and 254 of purge switch 86 which is a normally closed configuration. Transistor 210 will be off whenever signal is detected and multivibrator 202 output is constant. A high (+12 VDC) signal is thus provided via resistor 212 to the reset (pin 4) of free running oscillator 220 enabling it to oscillate. Free running oscillator 220 is the first half of a dual 556 timer. Oscillator 220 produces a square wave 50 millisecond pulse every 100 milliseconds. Resistors 224 and 226 and capacitor 228 set the time span of the pulse and the time span between the pulses.

The output of oscillator 220 is fed to a one shot multivibrator 230 via capacitor 232. One shot multi-vibrator 230 is the second half of the dual timer 556. One shot 230 passes a pulse whose pulse width is set by resistor 222, adjustable resistor 88, and capacitor 234. Adjustable resistor 88 is the injector drive flow rate control potentiometer.

The output pulse from one shot 230 is sent to Darlington power transistor 240 which in a preferred embodiment of the invention is a ULN 2062 device. This device is capable of outputting the pulse received from one shot 230 at a power level of at least 2 AMPS. The voltage output from Darlington transistor 240 is limited by resistor 242 which in a preferred embodiment is typically a three ohm resistor. From resistor 242, the output pulse is fed to the connector 78 which couples to the solenoid 48 of the injector 46 as shown in FIG. 1.

In order to bleed air from solvent supply line 118, a purge system is incorporated into the injector driver 70. Purge switch 86, when depressed, causes an open circuit between contacts 256 and 254 allowing line 258 to appear high (i.e., not low). This high signal is fed to multi-vibrator 220 allowing it to free run. Resistor 272 and diode 270 are pull-up resistors and overspike protector, respectively, and have no meaningful contribution to operation. Thus, when purge switch 86 is activated and power lead wire 80 and power lead wire 82 are connected to the battery, normal pulsed operation of the injector 46 through connector 78 occurs regardless of whether or not the ignition detector 74 is receiving a signal. This allows the operator to look through the transparent coupling hose 60 and see when solvent is being sprayed into the intake manifold 16 and to purge the system of residual chemical. Once button 86 is released, the injector cannot operate until the ignition detector 74 receives a signal through spark plug wire 32.

Several solvents and solvent fuel combinations have been used with varying success with this apparatus. Commercially available carburetor and fuel injector cleaners individually or mixed with unleaded gasoline have been found to be successful in removing shellac, gum, and other deposits from the various components of the intake manifold. These commercially available solvents, however, have not been found to be totally successful in removing deposits from the intake valves of the internal combustion engine.

Proprietary solvent mixtures manufactured by TEK Chemical, Inc., of Portland, Ore., have been found to be successful in removing deposits from the intake valves of the engine using the apparatus of the present invention. These particular solvents are understood to be mixtures of a number of ingredients including hydrocarbons, both heavy and light, surface active agents, chlorinated compounds including dichloromethane, and other compounds. These particular cleaners comprise mixtures of two types which are used seriatim in cleaning an engine. The first type is corrosive to certain metals, is highly volatile, and primarily breaks loose carbon and other deposits. The second type cleaning material is primarily a flushing agent. It is not as volatile or corrosive as the first type and its primary objective is to carry away the broken, loose material. The second type of cleaning material also contains lubricants and anti-corrosive coatings which coat the various components within the intake system. The second type cleaner may also contain top cylinder or valve lubricants. Because of the corrosiveness and highly volatile nature of the first type of solvent, the second type must be run through the engine within one hour of the first type to prevent the loosened and partially dissolved deposits from becoming attached to other components of the engine such as rings and exhaust valves.

It should be noted, however, that the specific apparatus and method of cleaning the intake components of an internal combustion engine is independent of the specific type of solvent used with the apparatus.

OPERATION

The following explanation describes how the various components of the present invention are utilized to clean the intake system of a internal combustion engine. The vehicle is parked, with the automatic transmission in park position and the parking brake set, or with the manual transmission in neutral and the parking brake set. The ignition is turned off and the engine is stopped.

The engine's fuel injectors 22 are disabled by removing the electrical connectors 24 from the fuel injectors 22 or disabling the vehicles electric fuel pump and the connector between the intake manifold 16 and the air cleaner 28 is removed. The air fuel metering block 40 is connected to the intake manifold 16 by means of the coupling hose 60 and hose clamps 62, 64. If the vehicle is equipped with an air flow meter in the air cleaner box 28, the draw-through air flow adapter 68 is connected to the air cleaner 28 of the engine 10 and a hose 66 is attached between the draw-through air flow adapter 68 and the air metering block 40.

A can of the first type intake manifold cleaning chemical is added to the upper reservoir 102 of the pumping unit 100. The interlock panel 150 on the pumping unit 100 is moved to the left to reveal the solvent control valve 108 and the pressure relief valve 136. The pressure relief valve 136 is opened to relieve any air pressure in the system. The solvent control valve 108 is then opened to allow the cleaning chemical to drain from the reservoir 102 into the tank 112. Both valves 108 and 136 are left in the open position until no liquid remains in the reservoir 102. Both valves 108 and 136 are now closed and the interlock panel 150 slid to the right to reveal the shop air input coupler 120.

The injector 46 is now mounted within the air metering block 40.

Shop air pressure from air line 142 is applied to the coupler 120 on the pumping unit 100. The injector drive lead 76 is now connected to the injector 46 mounted within the air metering block 40. The ignition detector 74 is now connected to any spark plug wire 32. The power lead wires are connected to the battery 34 observing proper polarity.

The air adjustment screw 44 on the air metering block 40 is adjusted to uncover two air inlet ports 162, 164. This position is approximately nine turns out on the air adjustment screw 44. The purge prime switch 86 on the injector driver 70 is depressed until solvent solution can be observed spraying from the fuel injector 46 mounted within the air metering block 40.

The operator now sits in the driver seat of the vehicle and depresses the accelerator to hold the throttle partially open. The key is inserted into the ignition and turned to start cranking the engine while simultaneously the injector drive flow rate control 88 on the injector driver 70 is turned to increase the flow of solvent to the injector 46. When the engine starts, and the idle has stabilized, the injector drive flow rate control 88 and the throttle are adjusted until desired RPM is obtained.

The engine RPM should never exceed 3,000 RPM. If the engine wants to run at a higher RPM, air is leaking into the engine at a point after the connection point of the air metering block 40 or the air adjustment screw 44 of the air metering block 40 is turned out too far. The ignition key should be immediately turned off and adjustments should be made before proceeding.

Should the RPM fall within an acceptable range, the engine continues to operate until the pumping unit 100 runs out of solvent.

The procedure is again repeated with the second type of the chemical cleaner. Once the second type of the chemical cleaner is completely exhausted, the air metering block 40, the injector driver 70, and the draw through air flow adapter 68 are all removed from the engine and the air intake manifold 16 is reconnected to the air cleaner 28. The vehicles' injectors 22 are enabled or the fuel pump is reconnected.

Although the preferred but not exclusive embodiment of the invention has been heretofore described, many modifications and variations, both in its structure and operation, equivalent in their characteristics, may be applied for by a person skilled in the art without departing from the spirit of the present invention. It is understood that all such modifications and variations are encompassed the scope of the invention, as defined by the appended claims.

We claim:

1. An apparatus for cleaning the intake system of an internal combustion engine comprising:

an air metering block having air passage means therein including an air outlet;

an adapter means to connect the outlet of said air metering block to the intake system of the engine;

air inlet means in said block communicating with said air passage means, an adjustment means within said air metering block for controlling the amount of air introduced into said air passage means;

an injector means for connection to the intake system of an engine for injecting a solvent into the intake system of the engine; and a control means for controlling said injector means to vary the amount of solvent injected into the intake system of the engine by said injector means.

2. An apparatus as recited in claim 1 wherein said air metering block includes an air inlet port and a plurality of air outlet ports communicating with said air inlet port wherein said adjustment means is a screw within said air inlet port to selectively cover or uncover all or portions of each air outlet port to adjust the amount of air allowed to enter said intake system.

3. An apparatus as recited in claim 1 wherein said injector means is an electrically operated pulse modulated fuel injector.

4. An apparatus as recited in claim 1 wherein said control means includes an electrical pulse generator outputting an electrical pulse having a adjustable pulse width for activating said injector means.

5. An apparatus as recited in claim 4 wherein said electrical pulse generator outputs an electrical pulse only when a signal is detected in a spark plug wire of said engine.

6. An apparatus for feeding a cleaning solvent into the intake system of an internal combustion engine comprising:

an air metering block having air passage means therein, including an air outlet passage;

an adapter means for connecting the outlet of said air metering block to the intake system of said engine;

air inlet means in said air metering block communicating with said air passage means;

an adjustment means within said air metering block for controlling the amount of air entering said passage means;

an injector means connected to said air metering block for injecting said solvent into said passage means;

a control means for controlling the amount of said solvent injected through said injector into said intake system;

a storage means for holding said solvent; and a pump means for pumping said solvent from said storage means to said injector means.

7. An apparatus as recited in claim 6 wherein said air metering block includes an air inlet port and a plurality of air outlet ports connected to said air inlet port and said adjustment means includes a means to partially cover said air outlet ports to vary the amount of air passed into the intake system by the inlet port.

8. An apparatus as recited in claim 6 wherein said injector means is an electrically operated pulse modulated fuel injector.

9. An apparatus as recited in claim 6 wherein said pump means includes a pressure tight container and a means to supply air pressure to said pressure tight container to pump said solvent from said container.

10. An apparatus as recited in claim 6 wherein said control means includes an electrical pulse generator outputting an electrical pulse having an adjustable pulse width for activating said injector means.

11. An apparatus for cleaning the intake system of an internal combustion engine comprising:

an air metering block, said air metering block having an air inlet port and a plurality of air outlet ports communicating with said air inlet port;

an adapter means for connecting said air metering block to the intake system of said engine such that said air outlet ports of said air metering block are in open communication with said intake system of said engine;

an adjustment means within said air metering block for selectively covering said air outlet ports to control the amount of air entering said intake system;

an electrically controllable injector means connected to said air metering block for injecting a solvent into said air passage;

a control means connect to said injector means for controlling the amount of said solvent injected by said injector means into said intake system;

a pressure tight container for holding said solvent; and a pump means for pumping said solvent from said storage means to said injector means.

12. A method for cleaning the intake system of an internal combustion engine comprising the steps of:

attaching an air metering block to the intake system of the internal combustion engine;

adjusting the air flow through the air metering block to a desired flow rate;

injecting a solvent into the intake system of the internal combustion engine;

controlling the quantity of solvent injected into the intake system of the internal combustion engine; and burning the solvent injected into the intake system within the engine.

13. A method for cleaning as recited in claim 12 wherein said step of injecting a solvent includes injecting a liquid combustible hydrocarbon blend.

14. A method for cleaning as recited in claim 13 wherein said liquid hydrocarbon blend includes dichloromethane.

15. A method for cleaning as recited in claim 12 wherein the step of attaching the air metering block to the intake system includes clamping an adapter to an intake manifold of the engine and clamping the air metering block to the adapter.

16. A method of cleaning as recited in claim 12 wherein the step of adjusting the air flow through the air metering block includes selectively covering or uncovering a plurality of air outlet ports with an air metering screw.

17. A method for cleaning as recited in claim 12 wherein the step of injecting a solvent into the intake system of the internal combustion engine includes introducing a solvent, under pressure, to an electrically controlled injector, and selectively activating said injector to allow solvent to spray into the intake system of the internal combustion engine.

18. A method of cleaning as recited in claim 12 wherein the step of controlling the quantity of solvent injected into the intake system includes sending an electrical pulse of a controlled time to the injector to activate the injector during the controlled time to allow solvent to pass through the injector during the controlled time.

19. A method of cleaning the intake system of an internal combustion engine, said engine having a plurality of fuel injectors associated with said engine, comprising the steps of:

disabling the fuel injectors associated with said engine;

adjusting the air flow into the intake system of said engine;

inserting an injector into the intake system of said engine;

supplying pressurized solvent to said injector; and controlling the quantity of solvent injected by said injector.

20. A method for cleaning as recited in claim 19 wherein the step of controlling the quantity of solvent injected by the injector includes sending a control pulse of electrical energy to the injector to activate the injector.

21. A method for cleaning the intake system of an internal combustion engine, said engine having a plurality of spark plugs, a plurality of spark plug wires connected to said spark plugs, a plurality of fuel injectors for feeding fuel to the cylinders of said engine, a fuel supply for supplying fuel to each of said fuel injectors, an air intake manifold for supplying air to said engine, an air cleaner, a connector for connecting said air cleaner to said intake manifold, and a battery associated with said engine, said cleaning method including the steps of:

disabling the fuel supply to prevent fuel from being supplied to the fuel injectors of the engine;

removing the connector from between the air cleaner and the intake manifold;

connecting an air metering block to the intake manifold;

connecting a draw-through air flow adapter to the air cleaner;

connecting a hose between the air metering block and the draw-through air flow adapter;

inserting an injector into the air metering block, said injector having a solvent inlet and an electrical connector;

filling a pumping unit with a first solvent; connecting said pumping unit to said injector to allow a first solvent to be pumped to the injector;

connecting an injector driver to said injector;

simultaneously cranking the engine and adjusting the injector driver to increase the flow of the first solvent through the injector, until the engine starts;

operating the engine until the pumping unit pumps all of the first solvent through the injector and the engine stops;

filling the pumping unit with a second solvent;

simultaneously cranking the engine and adjusting the injector driver to increase the flow of the second solvent through the injector, until the engine starts;

operating the engine until the pumping unit pumps all of the second solvent through the injector and the engine stops;

removing the injector driver, the air metering block, and the draw-through air flow adapter;

enabling the fuel supply; and reconnecting the connector to the intake manifold and the air cleaner.

* * * * *

UNITED STATES PATENT AND TRADEMARK OFFICE

CERTIFICATE OF CORRECTION

PATENT NO. : 4,989,561

DATED : February 5, 1991

INVENTOR(S) : Steven R. Hein, et al

It is certified that error appears in the above-identified patent and that said Letters Patent is hereby corrected as shown below:

Title page:

In the References Cited:

"Reye" should be -- Reyes --.

Column 5, line 31, "line 12" should be --line 142--.

Column 5, line 53,"unit loop" should be -- unit 100 --.

Signed and Sealed this

First Day of September, 1992

*Attest:*

DOUGLAS B. COMER

*Attesting Officer*

*Acting Commissioner of Patents and Trademarks*